United States Patent [19]

Korshunov et al.

[11] Patent Number: 4,463,796

[45] Date of Patent: Aug. 7, 1984

[54] CONTINUOUS METAL CASTING METHOD AND PLANT FOR PERFORMING SAME

[76] Inventors: Evgeny A. Korshunov, pereulok Otdelny, 5a, kv. 29, Sverdlovsk; Alexandr N. Kuznetsov, prospekt Mira, 118, kv. 49, Krasnoyarsk; Maxim B. Ovodenko, ulitsa Gorkogo, 19, kv. 5, Krasnoyarsk; Gennady G. Kuzmin, ulitsa Lebedevoi, 147a, kv. 9, Krasnoyarsk; Valery P. Kostrov, ulitsa Bazhova, 57, kv. 10, Sverdlovsk; Alexandr N. Timofeev, ulitsa Kachinskaya, 60a, kv. 3, Krasnoyarsk; Valery L. Bastrikov, ulitsa Kommunisticheskaya, 83, kv. 63, Sverdlovsk; Tatyana V. Meschaninova, ulitsa Malysheva, 127a, kv. 21, Sverdlovsk, all of U.S.S.R.

[21] Appl. No.: 351,169

[22] Filed: Feb. 22, 1982

[51] Int. Cl.[3] ..... B22D 11/126; B22D 11/10; B22D 11/124

[52] U.S. Cl. ..... 164/460; 164/440; 164/443; 164/485; 164/490

[58] Field of Search ..... 164/70.1, 71.1, 439, 164/440, 441, 443, 460, 477, 478, 484, 485, 488, 490

[56] References Cited

U.S. PATENT DOCUMENTS

| | | | |
|---|---|---|---|
| 944,370 | 12/1909 | Monnot | 164/490 X |
| 944,668 | 12/1909 | Douteur . | |
| 1,924,280 | 8/1933 | Hobart | 164/70.1 X |
| 3,459,255 | 8/1969 | Kolle | 164/440 X |
| 3,504,732 | 4/1970 | Wertli | 164/440 |
| 3,563,297 | 2/1971 | Wertli | 164/490 X |
| 4,073,333 | 2/1978 | Korshunov et al. | 164/484 X |
| 4,200,143 | 4/1980 | Matten et al. | 164/490 X |

FOREIGN PATENT DOCUMENTS

| | | | |
|---|---|---|---|
| 394099 | 9/1908 | France . | |
| 54-7497 | 4/1979 | Japan | 164/460 |
| 55-45569 | 3/1980 | Japan | 164/440 |
| 265385 | 3/1970 | U.S.S.R. . | |

*Primary Examiner*—Nicholas P. Godici
*Assistant Examiner*—Jerold L. Johnson
*Attorney, Agent, or Firm*—Fleit, Jacobson, Cohn & Price

[57] ABSTRACT

The continuous metal casting method includes continuously forming a portion of an ingot in the open-ended mold of the primary cooling zone under pressure, with a cold junction being formed at the end of the portion. The portion of the ingot is intermittently drawn into the secondary cooling zone, to produce the ingot subdivided by the cold junctions into portions of a required length. In the intervals between the successive drawing cycles, the ingot is treated in the secondary cooling zone to effect constrained shrinkage, while producing in the cold junction areas a bending strain of a value not short of the yield strength of the metal. The plant includes a vessel for the metal to be cast, communicating with the open-ended mold of the primary cooling zone. Arranged successively in the path of the ingot in the secondary cooling zone, downstream of the primary cooling zone, are a mechanism for drawing the ingot from the open-ended mold, and a mechanism for dividing the ingot into portions of the required length. The open-ended mold incorporates a chill for additional withdrawal of heat from the end face area of the portion of the ingot which is being formed in the mold.

5 Claims, 4 Drawing Figures

CONTINUOUS METAL CASTING METHOD AND PLANT FOR PERFORMING SAME

FIELD OF THE INVENTION

The invention relates to continuous metal casting techniques, and more particularly it relates to a continuous metal casting method and a plant capable of performing this method.

The invention can be used in metallurgy for casting various ferrous and non-ferrous metals, particularly, for casting ingots of lightweight metals and aluminum and magnesium base alloys.

BACKGROUND OF THE INVENTION

There are known continuous horizontal metal casting methods and plants for performing such methods (see, for example, "Continuous Casting" by M. V. Tchukhrov and I. V. Vyatkin, in Russian, Metallurgiya Publishers, Moscow, 1968; "Horizontal Continuous Casting of Non-Ferrous Metals and Alloys" by O. A. Shatagin, V. T. Sladkosheev et al., in Russian Metallurgiya Publishers, Moscow, 1974, pp. 22–46) wherein the division or separation of continuously cast ingots into portions of the predetermined length is performed by one of the conventional techniques, such as gas-cutting, cutting with disc saws, cutting with shears, and so on.

There are also known plants (cf. "Continuous Casting" by E. Hermann, Metallurgiya Publishers, Moscow, 1961, FIG. 488 in p. 168, FIG. 495 in p. 170, FIG. 582 in p. 200) for performing a method of horizontal continuous casting of metals, comprising a vessel adapted to contain a supply of the metal to be cast, an open-ended mold, means for connecting the mold to the vessel for the metal to be cast, a secondary cooling zone arrangement including a mechanism for drawing the ingot from the mold, an apparatus for severing or dividing the ingot into portions of a specified predetermined length by either disc saws or shears.

The use of disc saws for gas-cutting the continuously cast ingot into predetermined specified lengths as a part of a horizontal continuous metal casting technology involves the waste of metal and brings about the necessity of removing cuttings and scale, whereas the use of shears for cutting ingots results in a reduced time factor of the employment of the costly mechanical equipment.

There is known a method (cf. SU Inventor's Certificate No. 265,385; Int. Cl. B 22 d 11/00) of continuous casting of metals, including forming an ingot in the primary and secondary cooling zones and periodically drawing the ingot from the open-ended mold through a drawing step approximating the length of the mold. During the intervals between the successive cycles of drawing the ingot from the mold, under pressure and in molten metal, the skin or shell of the ingot is formed in the primary cooling zone. Then the ingot is finally formed in the secondary cooling zone and divided into portions of the specified predetermined length.

The forming of the ingot is conducted in accordance with this known method so that any discontinuity of the surface of the ingot, e.g. transverse cracks, should be avoided.

The known method does not offer any specific features of dividing the continuously cast ingot into the portions of the specified predetermined length as compared to those known heretofore; it is devoid of operations concerned with preparing the cast ingot to its efficient division into the portions of the specified predetermined length in correspondence with the step of drawing the ingot from the mold.

The plant for continuous casting of metals of the prior art (cf. "Horizontal Continuous Casting of Non-Ferrous Metals" by O. A. Shatagin, V. T. Sladkosheev, in Russian, Metallurgiya Publishers, Moscow, 1974, FIGS. 14–16, pages 42–44) comprises a vessel for the metal to be cast, connected with a mixer, as open-ended mold and means for connecting the vessel with the mold, including communicating channels. The vertical channel has the vessel connected thereto, while the horizontal channel is connected with the cooled mold through a sleeve made either of an asbestos-cement composition, or of stainless steel. Arranged successively behind the mold are the secondary cooling apparatus, a mechanism for drawing the ingot from the open-ended mold and flying shears for severing the continuously cast ingot into predetermined standard lengths.

The plant is devoid of elements and assemblies which could, with the ingot being periodically drawn from the open-ended mold in the primary and secondary cooling zones, prepare the continuously cast ingot for efficient and waste-free division into predetermined standard lengths, with moderate capital investment into facilities for such division.

The plant of the prior art would not provide facilities for forming an ingot in accordance with the herein disclosed method.

SUMMARY OF THE INVENTION

It is an object of the present invention to provide a continuous metal casting method and a plant capable of performing this method, which would enable to effect the preparation of an ingot being cast to efficient division into portions of a predetermined specified or standard length.

It is another object of the present invention to step up the yield of quality metal being continuously cast, while reducing the cost of equipment and energy required for dividing an ingot into portions of a predetermined standard length.

With these and other objects in view, the invention resides, in a continuous metal casting method including forming an ingot in the primary and secondary cooling zones, periodically drawing from the open-ended mold a portion of the ingot of a predetermined length, with a cold junction area being formed between the successively drawn portions, and subsequently dividing the ingot into the portions of the specified predetermined length using the said cold junctions, applying pressure from the molten metal side upon the skin or shell of the ingot being formed during the intervals between the cycles of drawing the ingot from the mold, in which method, in accordance with the invention, during the intervals between the successive cycles of drawing the ingot from the mold there is effected in the secondary cooling zone constrained shrinkage of the ingot, and there are produced at the cold junction areas, over a part of the cross-section of the ingot, bending stresses of a value not less than the yield strength of the metal, the dividing of the ingot into the portions of the predetermined specified length being effected by twisting the ingot at the reduced-strength cold junction.

It is expedient that the constrained shrinkage of the ingot in the secondary cooling zone be effected by clamping the ingot at the extreme points of the secondary cooling zone.

It is further expedient that repetitive alternating-sign strain be produced at the cold junction areas of the ingot within the secondary cooling zone, by applying transverse efforts to the junctions.

It is essential that, to produce the repetitive alternating-sign, strain, the transverse efforts be successively applied at the cold junction areas: first, from diametrally opposed directions, and then by shifting the transverse effort application points through an angle within a range from 15° to 90°.

It is also expedient that the cold junction of the ingot be additionally cooled while the transverse efforts are being applied thereto.

The essence of the present invention further resides in a plant for performing the method of continuous metal casting, comprising a vessel adapted to contain a supply of the metal to be cast, means for communicating the vessel with an open-ended mold, including communication channels to one of which the vessel for the metal to be cast is connected, while the other channel communicates with the open-ended mold which latter has an end closure, a mechanism for drawing the ingot from the open-ended mold, a mechanism for dividing the ingot into portions of a predetermined specified length, the above mechanisms being successively arranged behind the mold along the path of the progress of the ingot, in which plant, in accordance with the invention, there is included an element for additional withdrawal of heat from the end surface of the portion of the ingot being formed in the mold, arranged intermediate the mold and the means for connecting the vessel for the metal to be cast with the mold.

It is expedient that the element for additional withdrawal of heat from the end surface of the portion of the ingot being formed in the mold be made integral with the end closure of the mold.

BRIEF SUMMARY OF THE DRAWINGS

The invention will be further described in connections with embodiments thereof, with reference being made to the accompanying drawings wherein.

DETAILED DESCRIPTION OF THE INVENTION

Figure 1:
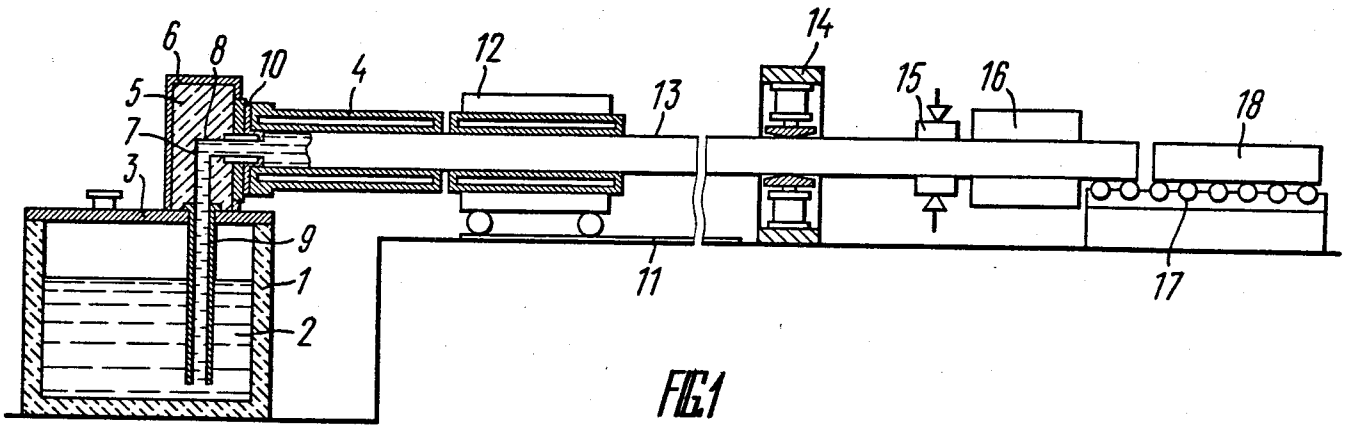
FIG. 1 shows schematically a plant capable of performing a method of continuous casting of metals in accordance with the invention.

The method of continuously casting metals into ingots includes forming in the open-ended mold of the primary cooling zone a portion of the zone, of a predetermined specified or standard length approximating the length of the mold. Within this primary cooling zone, pressure is applied to the skin or shell of the ingot being formed. Following the formation of the ingot portion with a cooled end, the ingot is drawn into the secondary cooling zone, whereafter the successive portion of the ingot is formed in the open-ended mold. Overcooling of the end portion of the ingot enables to avoid subsequent welding of the surface layers of adjacent successively cast portions of the ingot.

During the intervals between the successive operations or steps of drawing the ingot, there is effected in the secondary cooling zone the constrained shrinkage of the ingot, with the shrinkage strain being localized at the already pre-weakened cross-section of the ingot, and at the cold junction cross-section a circular crack will be formed. This is attained by clamping the ingot at the extreme points of the secondary cooling zone.

The additional reduction of the strength in the weakened layer—i.e. in the cold junction—is attained by applying to this junction within the secondary cooling zone successive alternating-sign efforts producing the bending strain in excess of the strength of the surface layers in the weakened cross-section of the ingot. As the outcome of this, the depth of the cracks already formed increases still further.

In certain practical cases the entire scope of the above operations may be not required, being dependent as it is on the properties of the metal being dealt with.

The performance of the disclosed method is illustrated in and by the following examples.

EXAMPLE 1

The step of drawing an ingot of aluminum alloys equals 500 mm, the spacing of the points of clamping the ingot equals 2 to 3 meters, and the average temperature drop of the ingot in the secondary cooling zone is 100° to 200° C. As the outcome of the constrained shrinkage, there is produced in the weakened cross-section area an annular crack 1 mm wide. By applying additionally to this weakened cross-section a succession of alternating-sign transverse efforts, the depth of the annular crack is increased.

In this case there is no practical need to perform the operation of applying the transverse efforts, since the 1 mm deep annular crack is already sufficient for high-quality separation of the predetermined specified length of the ingot by twisting.

EXAMPLE 2

With the step of drawing a steel ingot equalling 1000 mm, the spacing of the points of applying the clamping efforts being 2 to 3 meters, and the average temperature drop of the ingot in the secondary cooling zone being 350° to 450° C., the constrained shrinkage produces in the weakened cross-section a crack 0.7 mm wide.

With alternating-sign transverse efforts additionally applied to the weakened cross-section, the depth of the annular crack is additionally increased, which, when added to the initial depth of the annular crack, enables to attain high-quality shearing of the end of the predetermined specified length of the ingot by twisting.

The plant for continuous casting of metals includes a sealed-away vessel 1 (FIG. 1), preferably a heated one, adapted to contain a supply of the metal 2 to be cast. The lid 3 of the vessel 1 accommodates means for connecting the vessel 1 with an open-ended mold, including an adaptor 5 made of a refractory material, enclosed in a metal housing 6 and having communicating channels 7 and 8. The vertical channel 7 has connected thereto a metal conduit 9 submerged in the molten metal 2, whereas the horizontal channel 8 communicates with the cooled open-ended mold 4 of the primary cooling zone.

Arranged intermediate the adaptor 5 and the cooled mold 4 is an element 10 for additional withdrawal of heat from the end surface of the portion of the ingot being formed within the mold 4.

In the secondary cooling zone, guideways or tracks 11 support a reciprocating mechanism 12 for drawing the ingot 13 from the mold 14, preferably associated with a hydraulic drive (not shown).

Arranged further in the production path are a mechanism 14 for producing alternating-sign bending stresses in the ingot 13, a stationary mechanism 15 for clamping the ingot 13 and a mechanism 16 for dividing the ingot 13 into portions of a specified predetermined length, followed by a roller bed 17 for carrying away the separated specified lengths 18.

The mechanism 16 for dividing the ingot 13 into portions of the specified length is illustrated schematically, its function being to separate the specified lengths 18 by twisting.

The open-ended mold 4 (FIG. 2) of the primary cooling zone is connected to the horizontal channel 8 of the adaptor 5 through an insert sleeve 19 of a refractory material, a metal spacer 20 and the element 10 (FIG. 1) whose surface area is 40 to 90 percent that of the cross-section of the ingot 13 (FIG. 1) to be divided into portions.

Figure 2:
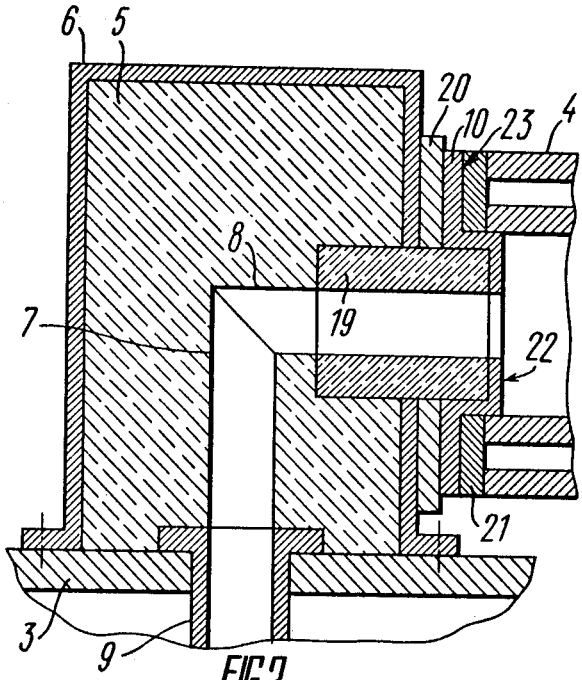
FIG. 2 illustrates in a greater detail the element for additional withdrawal of heat from the end surface of the portion of the ingot being formed in the mold in accordance with the invention.

This element 10 for withdrawing heat from the end part of the portion of the ingot 13 being formed in the mold 4 can be made integral with the end closure 21 (FIG. 2). The element 10 is made of a material possessing high heat conductivity, e.g. an aluminum alloy or copper.

The element 10 has working and non-working parts 22 and 23, respectively. The surface area of the working part 22 of the element 10 is 10 to 60% of the surface area of the cross-section of the ingot 13 being cast. The plane of the working part 22 of the element 10 may either belong to the plane of the end face of the mold 4, or else it may be offset into the mold 4 by several millimeters, e.g. 2 to 10 mm.

The non-working part 23 of the element 10 is pressed tight against the end closure 21 of the open-ended mold 4.

Figure 3:
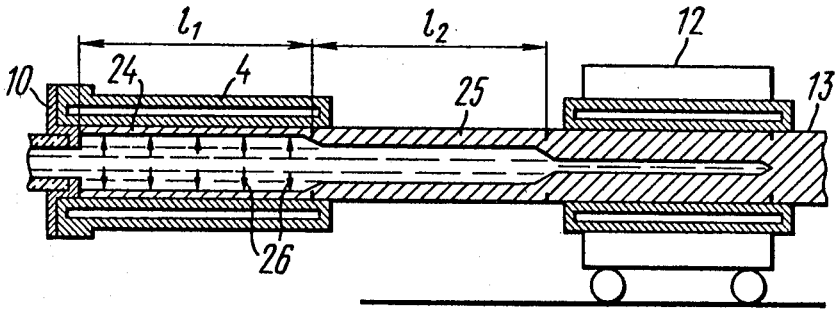
FIG. 3 shows the ingot at the initial stage of forming its skin or shell in the mold, according to the invention.

FIG. 3 of the appended drawings illustrates the ingot 13 at the initial stage of the formation of the skin or shell 24 of the portion of the ingot 13 being formed or molded in the mold 4, of the length $l_1$, directly after the preceding portion of the length $l_2$ equalling $l_1$ with the already formed skin 25 has been drawn from the mold 4. Arrows 26 indicate that the skin or shell 24 is being formed under pressure.

Figure 4:
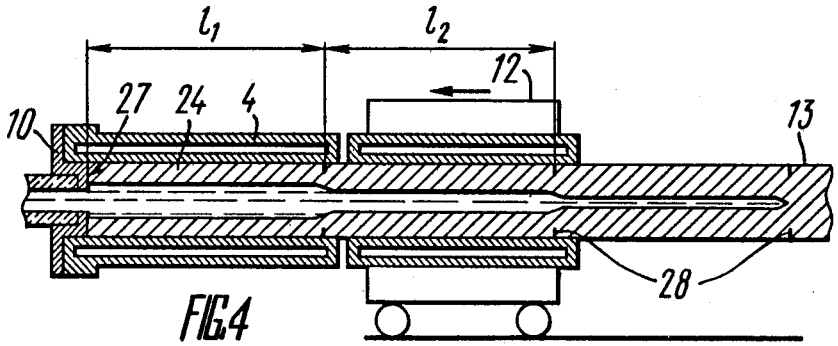
FIG. 4 shows the ingot at the final stage of forming its skin or shell, prior to drawing the ingot from the mold, according to the invention.

FIG. 4 illustrates the ingot 13 at the final stage of the formation of the skin 24 of the portion of the ingot 13, prior to this portion being drawn from the mold 4. The pressure in the liquid phase has been discontinued. The end face 27 of the formed skin or shell 24 is pressed against the element 10 by the effort produced by the mechanism 12 for drawing the ingot 13 from the mold 4.

The overcooled and unwelded joint between the successive portions of the specified length defines a cold junction 28.

The plant for performing the disclosed method includes a system for feeding the molten metal 2 (FIG. 1), which, depending on the actual metal 2 to be cast, may be of different types. One of the possible types includes an induction pump operable to feed the molten metal 2 into the feed conduit 9. This type is not shown in the drawing. Another type includes the sealed-away vessel 1 accommodating the submerged metal feed conduit 9. This type is shown in the appended drawing, FIG. 1, and the method and the plant for performing same are described here in connection with this type.

The production process of metal casting in accordance with the disclosed method is conducted, as follows.

The liquid metal 2 (FIG. 1) is poured into the vessel 1 through an appropriate opening in the lid 3, and the vessel 1 is sealed away.

The mechanism 12 for drawing the ingot 13 is operated to introduce into the mold 4 a dummy bar (not shown) and to press it against the element 10 being cooled. Pressure is built up within the vessel 1 above the surface of the molten metal 2 in the gas phase, its value being sufficient to raise the metal 2 in the feed conduit 9 and in the vertical channel 7 to the level of the horizontal channel 8 and to bring it into engagement with the dummy bar. The air is bled from the feed conduit 9 and channels 7 and 8 through a small opening in the dummy bar.

The mechanism 12 for drawing the ingot 13 from the mold 4 is operated to move the dummy bar through the predetermined drawing step equalling the predetermined specified length of the successive portions to be separated from the ingot 13.

The drawing step should not exceed the length of the mold 4.

As the ingot 13 is being drawn from the mold 4, the latter is filled with the molten metal 2. The drawing rate is from 100 to 300 mm/s.

Then there is maintained a preset interval or pause between the successive operations of drawing the ingot 13 from the mold 4, its duration being selected to correspond to the cross-section of the ingot 13 being cast and the length of the secondary cooling zone. The duration is preferably from 10 to 60 seconds.

During this interval or pause, the gas pressure within the vessel 1 is built up to a preset value, e.g. to 2–3 atm gauge when casting aluminum alloys, or else to 3–5 atm gauge when casting steel. This pressure enables to form within the mold 4 a high-quality skin or shell 24 (FIG. 3) under the stationary conditions, the skin 24 being urged against the walls of the mold 4 (FIG. 1) and against the element 10.

FIG. 3 of the appended drawings illustrates, as it has been already mentioned, the initial stage of the formation of the skin or shell 24 of the portion of the ingot 13 being formed, of a length $l_1$, within the mold 4 directly after the drawing from the latter the ingot 13 with the already formed skin or shell 25, of the length $l_2$. The skin 24 is being formed under pressure which provides for its high quality.

Then, at the final stage of the formation of the skin 24 at the end of the interval or pause, about 3 to 10 seconds before the ingot 13 is drawn from the mold 4, the pressure within the vessel 1 (FIG. 1) is discontinued. The mechanism 12 for drawing the ingot 13 from the mold 4 is operated to press the end face 27 (FIG. 4) of the solidified skin 24 against the cooled element 10 (FIG. 1), and its peripheral part is cooled to a temperature below one half of the melting point of the metal 2 being cast.

Then the dummy bar with the freshly formed portion of the ingot 13 (and, during the successive cycles, the ingot 13 along) is moved by the mechanism 12 through the drawing step, and, simultaneously, the successive portion of the molten metal 2 is fed into the open-ended mold 4.

Further the above described operation is repeated to form the successive portions of the ingot 13 in the mold 4.

As the result, there is being cast the ingot 13 wherein there are weakened cross-sections—the cold junctions 28 (FIG. 4)—spaced by the distance equalling the drawing step.

To reduce the strength of the ingot 13 at the cold junctions 28 still further, during the intervals between the successive drawing step the ingot 13 (FIG. 1) is clamped at the extreme points of the secondary cooling zone, i.e. intermediate the mechanisms 12 and 15.

An additional reduction of the strength of the weakened cross-section of the cold junction 28 (FIG. 4) is also attained by producing in the ingot 13 at the end of the secondary cooling zone alternating-sign bending stresses in the ingot 13, by applying to the latter transverse efforts with aid of the mechanism 14 (FIG. 1). It is expedient to shift the points of the application of the efforts through 15° to 90° (in case of a square ingot or bar 13—the shifting should be 90°).

The ingot 13 with the adequately weakened cross-section in the cold junction 28 (FIG. 4) areas is fed into the separation zone concurrently with the successive step of drawing the ingot 13 (FIG. 1) from the mold 4, with the portion of the ingot 13 to be separated being passed through the vise of the mechanism 15 and clamped so that the cold junction 28 (FIG. 4) is positioned intermediate the mechanism 15 (FIG. 1) for clamping the ingot 13 and the mechanism 16 for dividing the ingot 13. By twisting the specified length 18 of the ingot 13, this length 18 is separated from the continuous ingot 13 and carried by the rollers of the roller bed 17 toward the storage area.

Therefore, the disclosed method and plant for continuous casting of metals enable to reduce still further the strength of a cold junction 28 (FIG. 4) of an ingot 13 (FIG. 1) being cast. The division of the ingot 13 into specified lengths 18 by twisting it at the reduced-strength cross-sections enables to have clearlycut end faces of the ingot 13, which means that the division of the ingot 13 is waste-free.

The invention provides for failure-proof drawing from the mold 4 of the ingot 13 having at the extreme points of its specified lengths 18 the broken surface layer, owing to the strength of the remaining unbroken part of the respective cross-sections.

The above method provides for:

stepping up by about 0.5 to 1 percent the yield of the usable metal, owing to the waste-free division of the continuously cast ingot 13 into specified lengths 18, enabling to do without edge-trimming and to have shorter ends when the casting process is completed;

reducing the consumption of power by the process of dividing the cast ingot 13 into the specified lengths 18 by as much as 50%, owing to the attained reduction of the strength of the respective cross-sections of the ingot 13, and, consequently, of the efforts required for the division;

reducing the capital investment into the equipment for dividing the cast ingot 13 into the specified lengths 18 by about 20 to 30%, owing to the reduced dimensions and weight of the equipment and the reduced floor area it occupies;

reducing by approximately 20% the service and operating costs of the equipment for dividing the cast ingot 13 into the specified lengths 18.

What we claim is:

1. A method of continuous casting of metals, including the following successively performed operations:

forming in an open-ended mold defining a primary cooling zone a portion of an ingot of a specified predetermined length approximating the length of the open-ended mold, while applying pressure from the molten metal side to the skin of said portion of the ingot being formed, and while producing a cold junction at the end of said portion of the ingot;

drawing said portion of the ingot of the specified predetermined length from the open-ended mold into a secondary cooling zone;

continuously feeding molten metal into said open-ended mold for continuous formation of said portion of the ingot;

drawing periodically said portion of the ingot into said secondary cooling zone and producing in said secondary cooling zone an ingot made up of successive said portions separated by cold junctions;

providing for constrained shrinkage of said ingot in said secondary cooling zone in the intervals between successive drawing operations;

producing within said secondary cooling zone and during the intervals between successive drawing operations in the areas of said cold junctions between said portions of the ingot a bending stress of a value not less than the value of the yield strength of ingot material;

dividing said ingot into the specified predetermined lengths corresponding to said portions of the ingot of the predetermined specified length, by twisting at said cold junctions.

2. A method of continuous casting of metals, as set forth in claim 1, wherein said constrained shrinkage of said ingot is provided by clamping said ingot at the extreme points of said secondary cooling zone.

3. A method of continuous casting of metals, as set forth in claim 2, wherein there are produced repetitive alternating-sign stresses, by applying transverse efforts to said cold junctions within said secondary cooling zone.

4. A method of continuous casting of metals, as set forth in claim 3, wherein said transverse efforts are applied at said cold junctions in succession at diametrally opposed sides of said ingot, and then at points shifted through an angle from 15° to 90°.

5. A method of continuous casting of metals, as set forth in claim 3, wherein said cold junction between said portions of said ingot is additionally cooled, as said transverse efforts are being applied thereto.

* * * * *